United States Patent [19]

Horowitz

[11] 4,215,342

[45] Jul. 29, 1980

[54] MERCHANDISE TAGGING TECHNIQUE

[75] Inventor: Peter Horowitz, Silver Spring, Md.

[73] Assignee: Intex Inc., Bethesda, Md.

[21] Appl. No.: 892,283

[22] Filed: Mar. 31, 1978

[51] Int. Cl.[2] ..... G08B 13/24

[52] U.S. Cl. ..... 340/572; 343/6.8 LC

[58] Field of Search ..... 340/572, 551; 343/6.8 R, 6.8 LC

[56] References Cited

U.S. PATENT DOCUMENTS

| | | | |
|---|---|---|---|
| 2,438,197 | 3/1948 | Wheeler . | |
| 2,584,592 | 2/1952 | Kehbel . | |
| 2,954,538 | 9/1960 | Horgan . | |
| 3,465,724 | 9/1969 | Broadbent . | |
| 3,500,373 | 3/1970 | Minasy . | |
| 3,696,369 | 10/1972 | Laymon et al. . | |
| 3,713,133 | 1/1973 | Nathans . | |
| 3,740,742 | 6/1973 | Thompson et al. | 340/572 |
| 3,774,238 | 11/1973 | Hardway, Jr. . | |
| 3,790,945 | 2/1974 | Fearon . | |
| 3,818,472 | 6/1974 | Mauk et al. | 340/572 |
| 3,820,103 | 6/1974 | Fearon . | |
| 3,820,104 | 6/1974 | Fearon . | |
| 3,836,842 | 9/1974 | Zimmerman et al. . | |
| 3,859,624 | 1/1975 | Kriofsky et al. | 340/572 |
| 3,863,244 | 1/1975 | Lichtblau . | |
| 3,891,980 | 6/1975 | Lewis et al. | 340/572 |
| 3,938,125 | 2/1976 | Benassi . | |
| 4,095,214 | 6/1978 | Minasy | 340/572 |

*Primary Examiner*—Glen R. Swann, III

*Attorney, Agent, or Firm*—Fisher, Christen & Sabol

[57] ABSTRACT

A merchandise tagging technique includes a transmitter and receiver module, called hereinafter the interrogator, located at the merchandise inspection point. When a piece of merchandise containing an activated tag passes in the vicinity of the interrogator, an alarm signal occurs. The transmitter produces a pulsed magnetic field which excites the tag. The magnetic oscillations produced by the tag are detected by the receiver-each tag magnetic burst being coherently accumulated.

The tag is a small, passive, magnetically-permeable core with a winding on it which results in a self resonant structure that produces magnetic oscillations when excited by the transmitter. These oscillations are detected by the receiver and processed for optimal enhancement during the residence time of tagged merchandise passing by the interrogator. The tags can be small and mass-produced at low cost, which makes this scheme an economically valuable technique.

Besides merchandise protection, the tag can be used on persons, vehicles and the like for the purpose of selective detection or identification.

2 Claims, 36 Drawing Figures

MERCHANDISE TAGGING TECHNIQUE

BACKGROUND OF THIS INVENTION

This invention relates to a merchandise, vehicle, or personnel tagging technique for the purpose of selective detection or identification when carried or passed through the system.

The problem of theft (shoplifting) is a serious economical problem for almost all categories of business, including retail stores, manufacturing facilities, etc. There is an increasingly serious problem world industry-wide involving the pilferage of manufactured items from storage facilities, such as, warehouse and department stores, industrial plants, military installations, by service personel, employees, customers, visitors and incidental parties.

One approach has been to tag each item of merchandise and then use various techniques to detect the tagged item when it is being stolen. Most prior methods of pilferage control and prevention are too expensive to be used on a large scale-particularly the tags are too large and/or expensive. A number of different tag implementations are already in use which variously employ packaged resonant radio antennas, non-linear diode/antennas, permanent magnets. There are certain weaknesses associated with each approach; for example, the relative ease with which to shield the electromagnetically illuminated tags either with a person's body in the microwave systems or with small amounts of normally carried metal in the radio frequency implementations. The permanent magnet tag systems on the other hand are susceptible to false alarms from remanent magnetism in steel arch supports in shoes and nearby similar magnetized moving bodies.

U.S. Pat. No. 3,836,842 is a method whereby locations, typically outside locations, are marked by a passing marking device placed therewith. The marking device is responsive in a damped oscillatory manner when radiated by at least one pulse of magnetic energy, i.e., an induction field. An interrogating instrument is the source of the induction field. After an induction field has been generated, the interrogating instrument monitors the frequency range within which the marking device is resonantly responsive. When a response is detected the interrogating instrument provides an indication of the response. The marking device is particularly useful for marking locations which are buried or are from time to time concealed. With a portable interrogating instrument, an operator, traversing the general area of a location, is thus able find the location without the aid of a visible stake or other similar fixture.

The marking device of U.S. Pat. No. 3,836,842 can be an encapsulated passive resonant electrical circuit of an elongated cylindrical shape. A coil of insulated conductor wire placed on a ferrite magnetically soft elongated core forms the inductive portion of a tank circuit. A capacitor connected in parallel with the coil completes the tank circuit. Ideally, an almost infinite Q circuit is stated to be desirable and thus the coil and the capacitor must be of reasonably low resistance and loss, respectively. Likewise the core must be of a low loss material. It is also stated to be desirable that the resonant frequency be stable with respect to wide temperature variations. Since the coil and core inherently have positive temperature coefficients the capacitor is preferably of the polystyrene type having a negative temperature coefficient. Thus the marking device is at least partially temperature-compensated.

The tag system of the patent is not commercially viable for pilferage control, detection and prevention as large quantities of inexpensive tags are needed to achieve that objective.

BROAD DESCRIPTION OF THIS INVENTION

An object of this invention is to provide a merchandise tagging technique for use in the control detection and prevention of pilferage of manufactured items and the like. Another object is to provide a method of identifying or detecting vehicles, persons or items passing through the system. A further object is to provide a tagging and identification technique which functions effectively in electromagnetically harsh environments and effectively operates when attempts to shield or jam the tag signal are made. Another object of this invention is to provide a tag that is small, inexpensive and easily mass produced on a large scale at a low cost. Other objects and advantages of this invention are set out herein or are obvious herefrom to one ordinarily skilled in the art.

The apparatus, device and process of this invention achieves the advantages and objects of this invention.

SUMMARY OF THE INVENTION

This invention involves a tagging technique for use in pilferage control of manufactured items and the like or identification of personnel, vehicles and other items. The system of this invention includes a transmitter and receiver module, called hereinafter the interrogator, located at the item inspection point. When a piece of merchandise containing an activated tag, for example, passes in the vicinity of the interrogator, an alarm signal occurs.

The tag is a small, passive, magnetically-permeable core with a winding on it which results in a self resonant structure that produces magnetic oscillations when excited by the transmitter. These oscillations are detected by the receiver and processed for optimal enhancement during the residence time of tagged merchandise passing by the interrogator. The tags can be small and mass-produced at low cost, which makes this invention an economically valuable technique.

The system of this invention uses low frequency AC magnetic fields only, which readily penetrate metal and are not shielded by the human body. Because this tag signal is very different relative to signals created from the passage of personal items passing by, it overcomes the prior art disadvantages associated with tags using permanent magnets. The tag signal is a lightly damped sinusoidal magnetic field burst which is repetitively excited by the stationary pulsing transmitter. Since the tag signal is precisely coherent with the transmitter (i.e., builds up in syncronism with the transmitter and starts its decay exactly the same way at the end of each transmitter burst), it is therefore possible to coherently add the amplitude of each tag burst during the residence time of the tag in the vicinity of the transmitter and receiver zone.

This feature of the system of this invention increases detection threshold signal to noise roughly $\sqrt{M}$ over non-coherent systems, where M is the number of pulses coherently integrated in the receiver during residence of the tag which would typically be on the order of 0.5 second; for example, the time for personnel to pass through the receiver transmitter zone.

With a transmitter repetition rate of 500 Hz, for example, this yields an enhancement of 24 decibels which can be exploited to reduce the tag size and cost, while making usage more convenient.

Further detection enhancement of the tag signal can be achieved by proper selection of the transmitter signal. For automated surveillance analysis and measurement indicate sinusoidal burst of duration about equal to the tag's envelope decay time constant; and the center frequency of the transmitter and nominal tag burst oscillations are made equal.

Additional performance enhancement can be achieved in the presence of harsh electromagnetic environments by windowing the demodulation (see FIG. 19) which can also be used to provide distinct channels for identifying different tags on the basis of resonant frequency. If the system must be operated in the presence of sinusoidal interference on the same frequencies as the tags resonance, simple pseudo random polarity coding of interrogator will suppress response to external sinusoids by more than L, where L is the number of bits in the sequence.

For the maximum achievable detection of the tags which have a spread of resonant frequencies in actual use; a frequency-adaptive interrogator matches the transmitter and receiver reference frequency to that of the tag passing through the zone of the interrogator. (See FIGS. 32, 33, 34, 35 and 36.)

The major thrusts of this invention, and advance of this invention over the prior previous art systems, are in the following areas:

(1) optimal design of transmitter waveform and receiver processes using statistical communication theory to allow construction of tag using minimum amount of permeable material;

(2) automated tag construction:
- (a) wire winding system which controls resonant frequency,
- (b) wire winding technique which eliminates the need for any connections to the wire, and no additional components; and (3) additions to basic interrogator for:
- (a) operation in electromagnetically harsh environments
  - (i) pseudo random polarity sequencing to suppress response to interfering sinewaves in same frequency band as tag resonant frequency,
  - (ii) coherent detector windowing to suppress out-of-band response of receiver,
- (b) multi-channel receiver design to identify different classes of tags where desirable with increased sensitivity to individual tags, and
- (c) adaptive frequency interrogator which matches the transmitter and coherent detector reference frequencies to the particular tag in the zone of the interrogator for maximum tag detectability.

The tag of this invention is basically a passive electronic tagging transponder. The tag is a unit composed of a core having a high permeability and a coil circumscribing the core. The coil can be a wire winding. Preferably the core is elongated, such as a cylinder or a flat. The core can essentially have any dimensions, for example, a cylinder 5 mm. in diameter and 7 mm. in length. The tag can be very small, being limited only in the capability of technology to provide a minaturized core and winding thereon.

Preferably the core is a magnetically soft ferrite material, but any suitable material having a high permeability can be used. The core used in this invention is not a permanent magnet.

The winding is made from a conductive wire, such as, copper wire.

Preferably a conductive paint, such as aluminum paint, is placed in the winding of the tag to form a paint layer thereon. When aluminum paint, for example, is used, the aluminum particles fill up the spaces in the winding and thereby increase the interwinding capacitance.

As the tags of this invention can be mass produced very cheaply, this invention provides an inexpensive, practical and effective way of tagging retail merchandise, objects d'art, museum pieces, or anything to be protected from theft.

An advantage of the tag (or marking device) of this invention is that it, unlike the marking device of U.S. Pat. No. 3,836,842, does not require the use of a capacitor or other termination.

The preferred embodiment of this invention is shown in FIGS. 1 to 36 and the accompanying description thereof.

DESCRIPTION OF THE PREFERRED EMBODIMENTS

Figure 1:
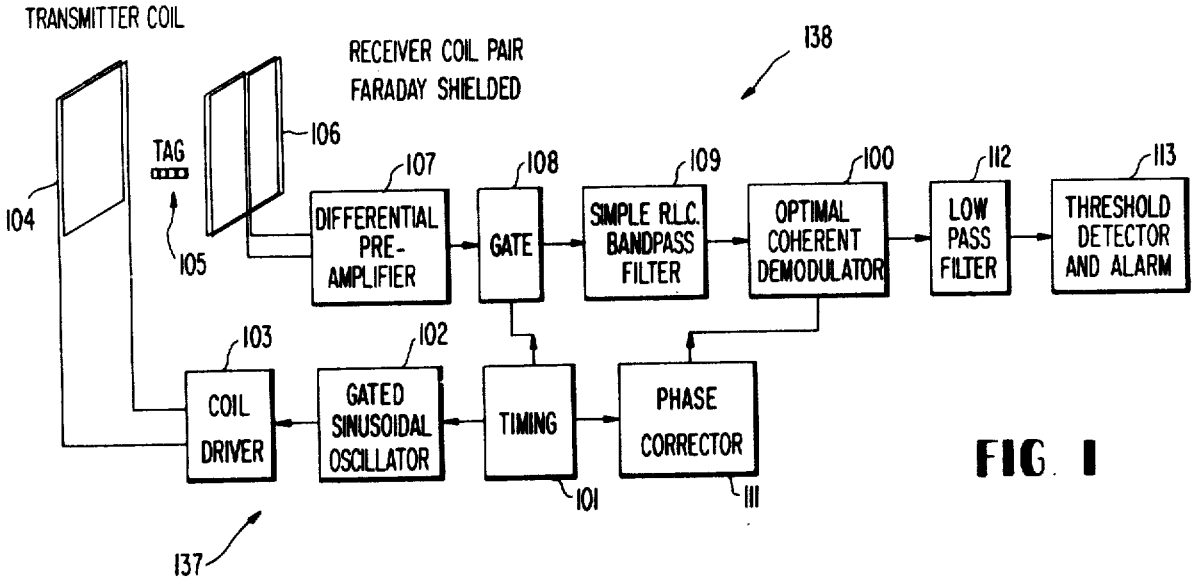
FIG. 1 is a block diagram of the basic system of an embodiment of this invention.
Figure 2:
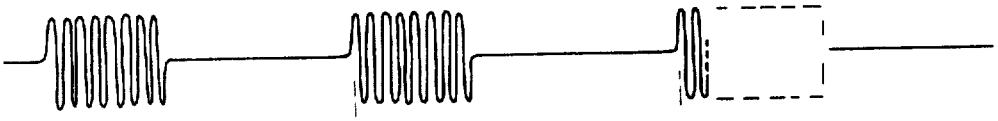
FIGS. 2 to 7 are certain waveforms occuring during the operations of the basic systems of FIG. 1.
Figure 3:
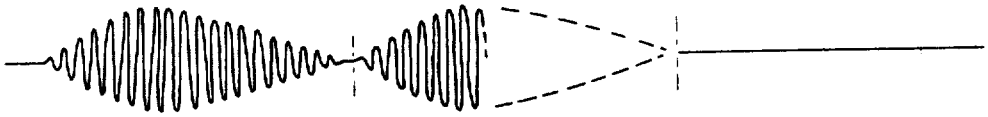
Figure 4:
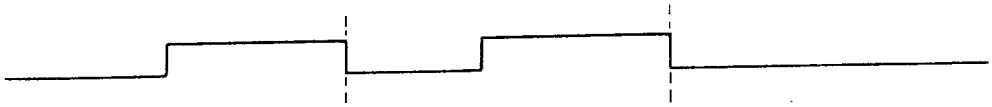
Figure 5:
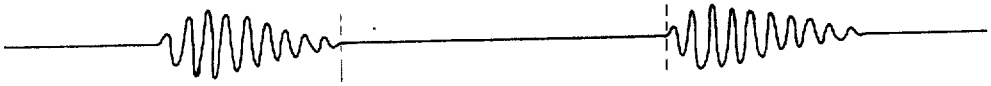
Figure 6:
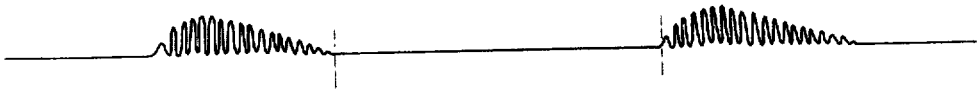
Figure 7:
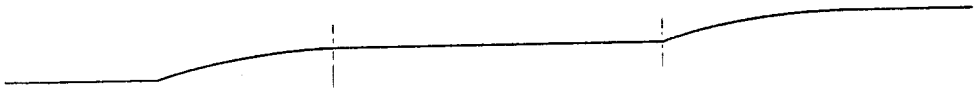

In FIG. 1, timing module 101 generates a gating signal to sinusoidal oscillator 102. The output of oscillator 102 is amplified by coil driver 103 and delivered at the desired current level to transmitter coil 104. Numeral 137 generally represents the transmitter, and numeral 138 generally represents the receiver module. The oscillating magnetic field around transmitter coil 104 resonantly excites tag 105. (See FIG. 2 for the waveform of the oscillating magnetic field around transmitter coil 114.) A portion of the energy from each transmitter cycle is accumulated in the secondary magnetic field and winding capacitance of tag 105. The amplitude (hence energy) of each such cycle reaches a limiting level determined by the electromagnetic and circuit losses of tag 105. At this point, transmitter 104 is turned off (see the waveform set out in FIG. 2), and the magnetic energy in tag 105 resonantly dies away (see the waveform set out in FIG. 3). This sinusoidally varying magnetic flux induces a voltage in receiver coil 106 which is Faraday shielded and balanced to help suppress outside interference. The voltage in receiver coil 106 is amplified by wideband preamplifier 107, which rapidly recovers upon removal of the transmitter burst. Then the voltage in receiver coil 106 is applied to gate 108 (see the waveform set out in FIG. 4), which only passes the signal during the quiet interval when transmitter 104 is off. The signal is then slightly pre-filtered by ordinary RLC bandpass filter 109 (see the waveform set out in FIG. 5) to block wideband noise and interference. The signal is then applied to coherent demodulator 100. Demodulator timing is generated by means of timing module 101 and phase shifted by phase corrector 111 to compensate for receiver phase shifts in receiver coil 106, differential preamplifier 107, gate 108 and RLC bandpass filter 109. The demodulator output (see the waveform of FIG. 6) is then summed in low pass filter 112 (see the waveform of FIG. 7), which has a 0.5 second time constant to include all pulses received from tag 105 during typical residence time near the interrogator (101, 103, 106–109, 100). If the sum exceeds a specific magnetic (plus or minus) threshold, detector system 113 activates its incorporated alarm.

Figure 8:
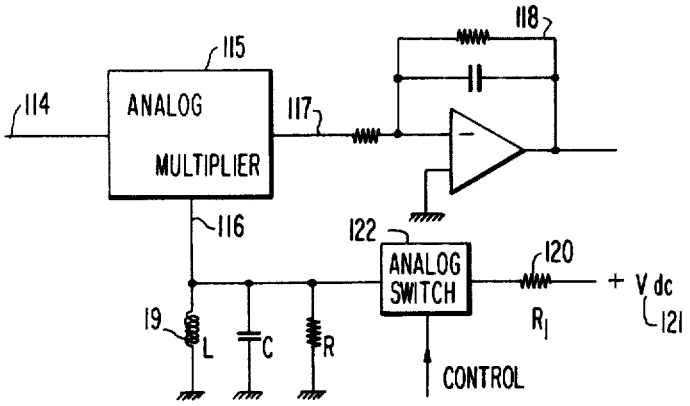
FIG. 8 is a circuit diagram of an analog cross-correlation detector optimal coherent demodulator implementation of the basic system of FIG. 1.
Figure 9:
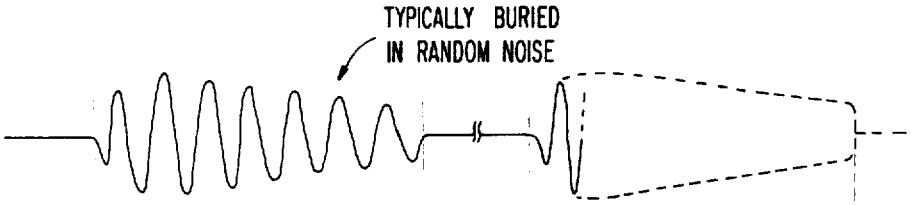
FIGS. 9 to 13 are certain waveforms associated with the modified basic system of FIG. 8.
Figure 10:
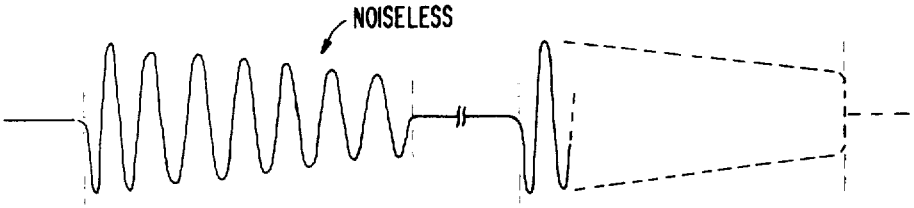
Figure 11:
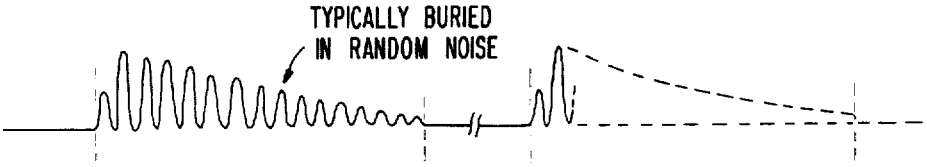
Figure 12:
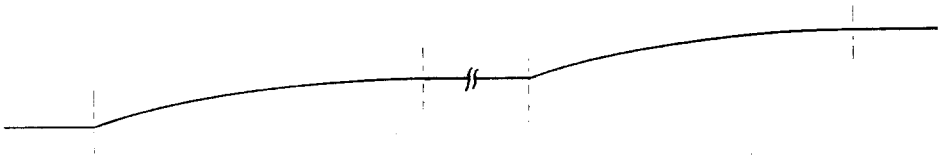
Figure 13:
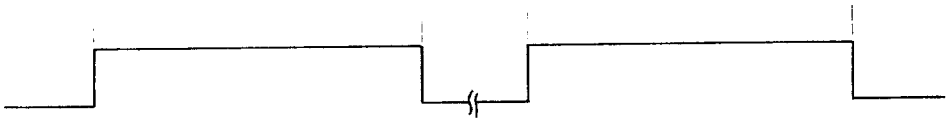

In FIG. 8, a detector implementation is shown which is simple and optimum for extraction of the tag signal buried in wideband, white noise. The amplified and pre-filtered tag signal plus noise (see the waveform of FIG. 9—typically buried in random noise) is applied to one terminal 114 of analog multiplier 115. (A Raytheon 4200 is very suitable for this application.) A phase-corrected noiseless replica of the nominal tag signal is injected into the other analog multiplier terminal 116 (see the waveform of FIG. 10—noiseless). The product of these waves (see the waveform of FIG. 11—typically buried in random noise) at the output of multiplier 117 is added and stored in lowpass filter 118 (see the waveform of FIG. 12). The noiseless reference signal at 116 is generated by removing the dc current supply into inductor 119 via resistor $R_1$ 120 and dc current supply 121. The current is removed by opening switch 122 with the control signal (see the waveform of FIG. 13—see also FIG. 4). The current flowing in L (inductive) then decays in an oscillatory manner in the RLC circuit with envelope decay adjusted with R (resistance).

Figure 14:
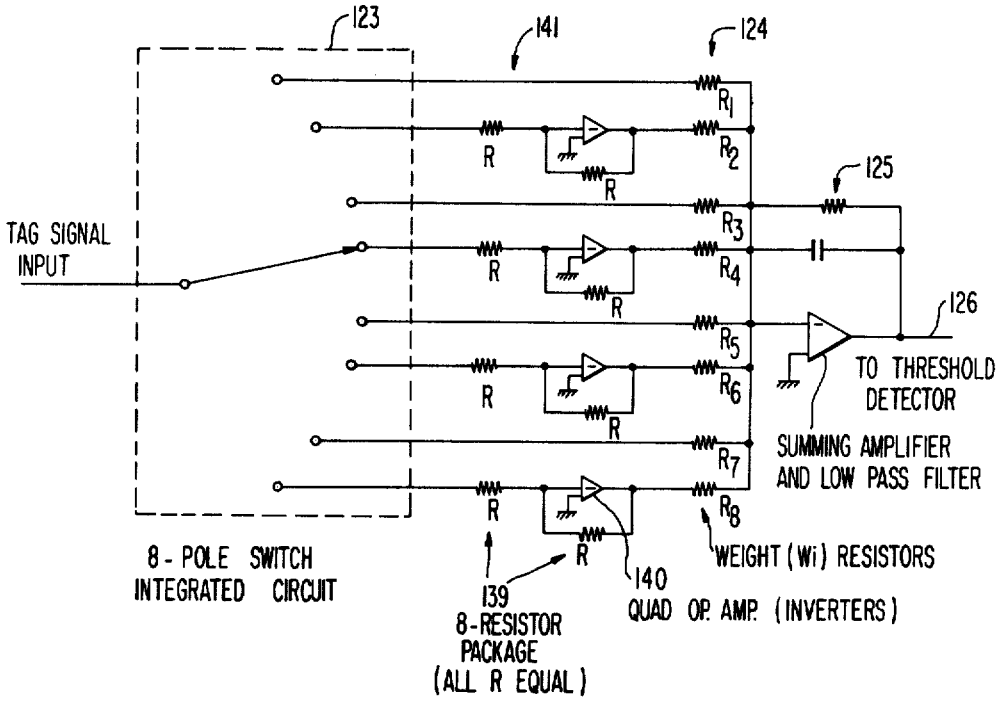
FIG. 14 is a circuit diagram of an N-pole switch version of the cross-correlation detector of FIG. 8.
Figure 15:
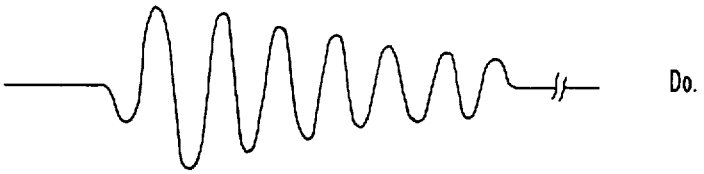
FIGS. 15 to 18 are certain waveforms associated with the modified basic system of FIG. 14.
Figure 16:
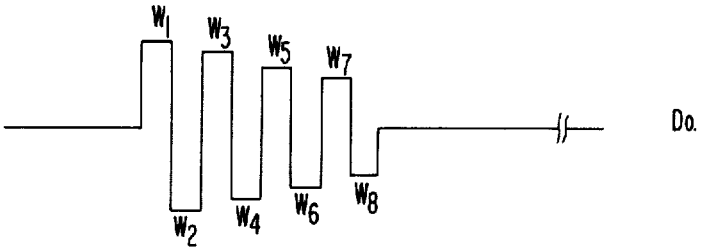
Figure 17:
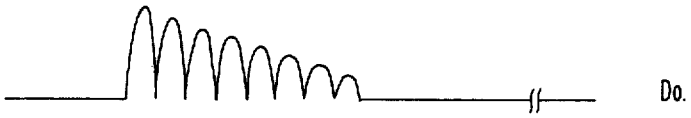
Figure 18:
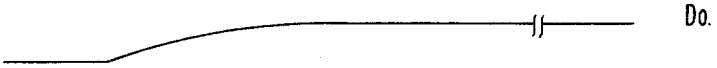

In FIG. 14, cross-correlation detector circuit 141 includes synchronous switch 123 (8-pole switch integrated circuit) whose input (see the waveform of FIG. 15) is normally buried in random noise. (A Motorola Corp MC14051B integrated circuit is suitable for switch 123.) Numeral 139 is an eight resistor package (all R are equal), and numeral 140 is an inverter (amplifier). Switch 123 synchronously steps (see the waveform of FIG. 16) with a transfer loss at each step position defined by the resistors $R_1$, $R_2$. . . $R_8$ (see numeral 124) which approximates the actual tag waveform itself, hence generating the approximate correlation function as a current into summing amplifier 125 (see the waveform of FIG. 17). The output of the summing amplifier—low pass filter 125 is shown (see the waveform of FIG. 18) for one burst pulse. As an example of an implementation of circuit 141: the eight resistors 124 all of value R are available from Bourns, Inc., series 4116R, in a 16 pin dual in-line package; and the four operational amplifiers 150 are available from Texas Instruments Corp. model TL074 in a 14 pin dual in-line package.

Figure 19:
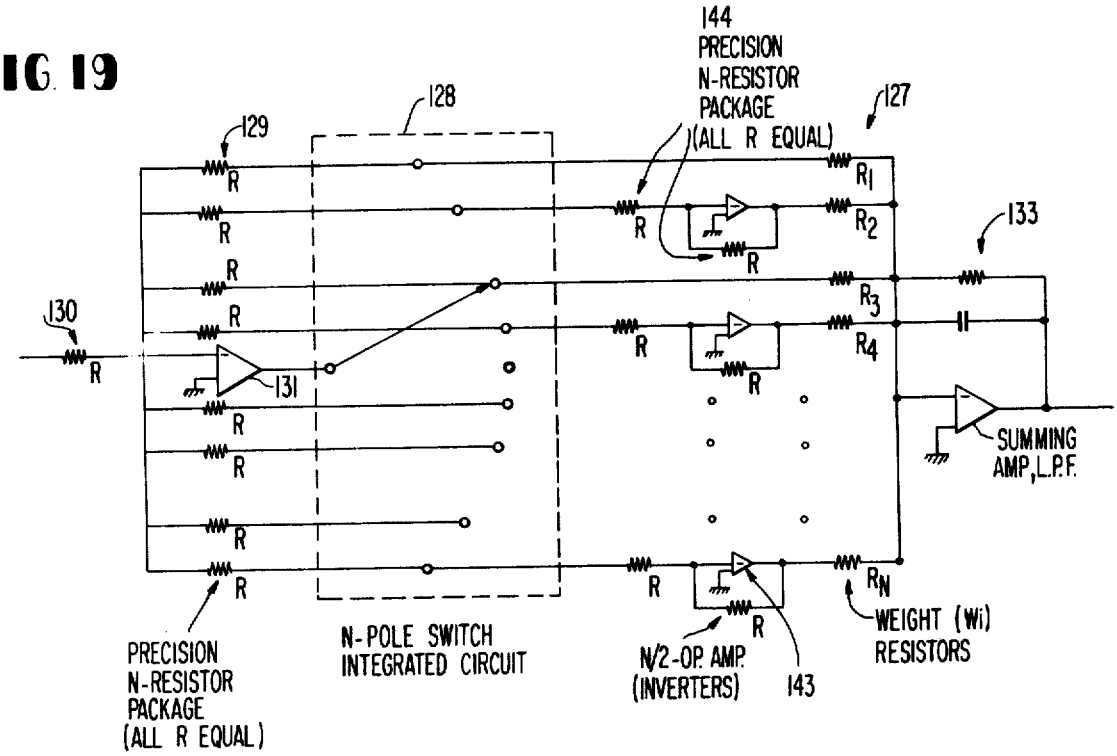
FIG. 19 is a circuit diagram of a modification of the N-pole switch version of the cross-correlation detector of FIG. 14 wherein there is an addition of negative feedback around the N-pole switch.
Figure 20:
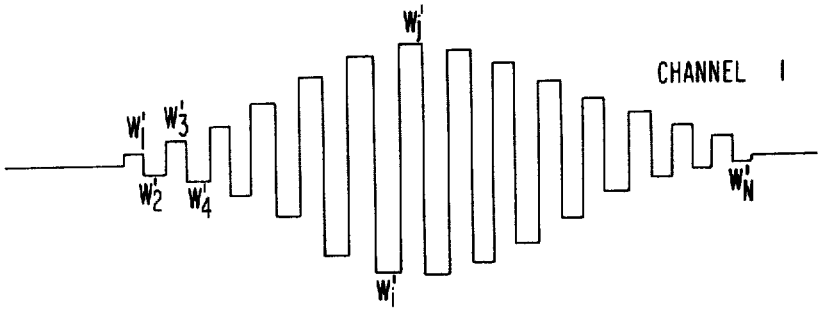
FIGS. 20 to 22 are certain waveforms associated with the modified basic system of FIG. 19.
Figure 21:
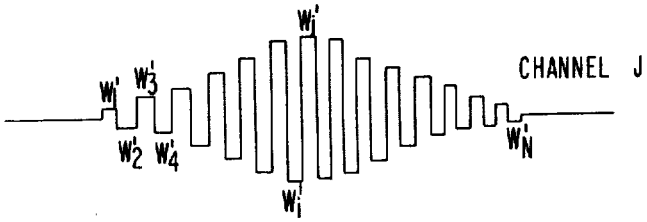
Figure 22:
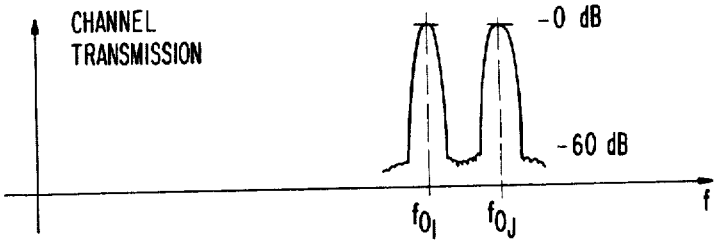

FIG. 19 is a precision version of circuit 141 of FIG. 14 for the purpose of defining the weights Wi 127 to 0.1 percent or better while using modest and mass-producible circuitry. With such precision the demodulating function can be spectrally limited to a well-controlled band (see the waveform of FIG. 20). The spectral response of the waveform shown in FIG. 22, can be attained, for example, with a 3-term Blackman-Harris weighing set. This precision is possible because the major cause of non-linearity of N-pole integrated circuit switch 128 is made very ideal by enclosing it in negative feedback loop 129–131. Numeral 129 is a precision N-resistor package (all R are equal), numeral 130 is a resistor and numeral 131 is an amplifier. Numeral 143 is an inverter (N/2 op. amp.), and numeral 144 is a precision N-resistor package (all R are equal). FIGS. 20 and 21 are examples of weight sequences generated by changing the switch stepping rate, respectively, labelled channel I and channel J. FIG. 22 shows the corresponding spectral responses for the weight sequences for channel I and channel J. This indicates that several precision N-pole demodulators stepping at different rates, but all incorporated in one receiver, can be used as a channel bank to identify classes of tags 105 with specific but different resonant frequencies.

FIG. 14 is a circuit diagram of an N-pole switch version of the cross-correlation detector of FIG. 8; which is marginally more complex, but has the added flexibility and advantage of allowing precision weighting sequences and being highly stabilized against environmental variations. FIG. 19 is an elaboration of these capabilities with the addition of negative feedback around the N-pole switch making the correlator stable enough for three-decimal-place weighting coefficient accuracy for good spectral sideable suppression, interference rejection, and multi-channel comparison.

Figure 23:
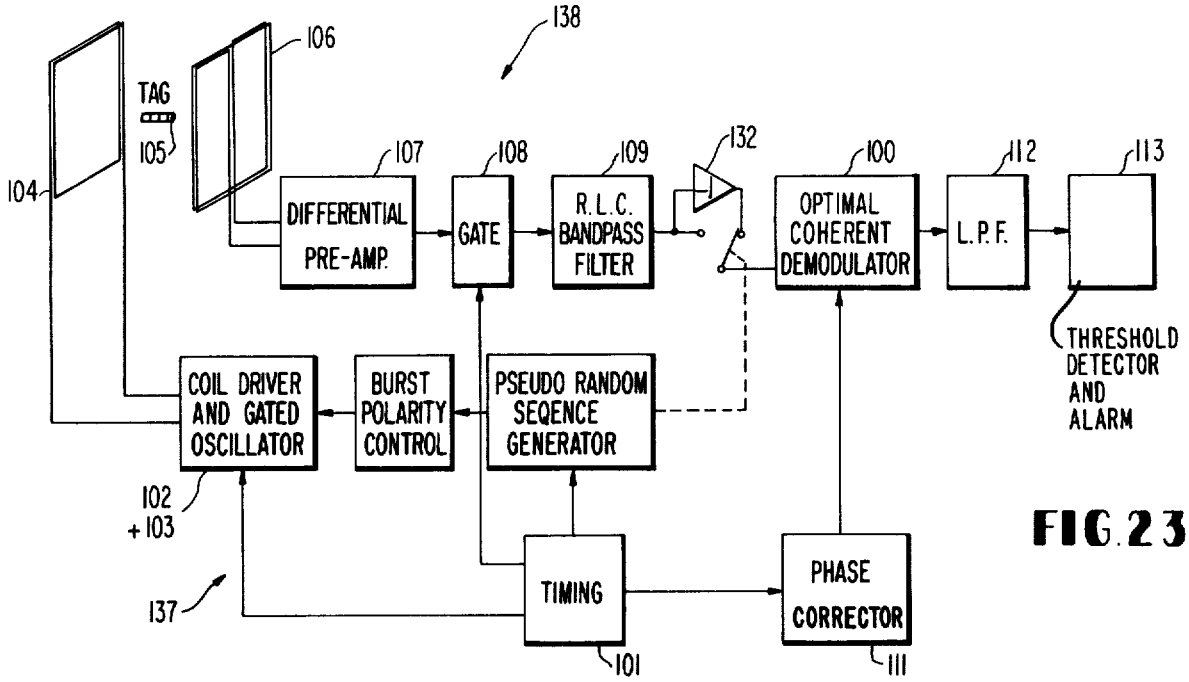
FIG. 23 is a block diagram of a modification of the basic diagram of the FIG. 1 wherein pseudo random coding is incorporated to suppress interference within the operating range of the tag of this invention.
Figure 26:
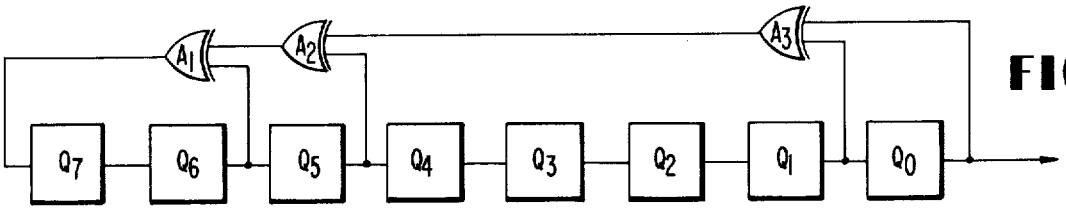
FIG. 26 is a schematic diagram of the pseudo-random sequence generator of FIG. 23.

In FIG. 23, the use of pseudo random coding is used to suppress interference inside the operating range of tag 105. FIG. 23 shows a system which is a modified version of the system shown in FIG. 1. In FIG. 23, the apparatus includes: timing module 101; sinusoidal oscillator 102 and coil driver 103; transmitter coil 104; tag 105; receiver coil 106; preamplifier 107; gate 108; ordinary RLC bandpass filter 109; coherent demodulator 100; timing module 101; corrector 111; low pass filter 112; specific magnetic (plus or minus) threshold, detector system 113; a pseudo random sequence generator; and a burst polarity control. (Numeral 137 generally represents the transmitter and numeral 138 generally represents the receiver module.) The functions are generally those described under FIG. 1. For example, if an 8 bit shift register is used to generate the code (implementation requires a total of two integrated circuits-see FIG. 26), interference suppression at the clock rate will be $1/(2^8-1)$ which is 48 db. better than without coding.

Figure 24:
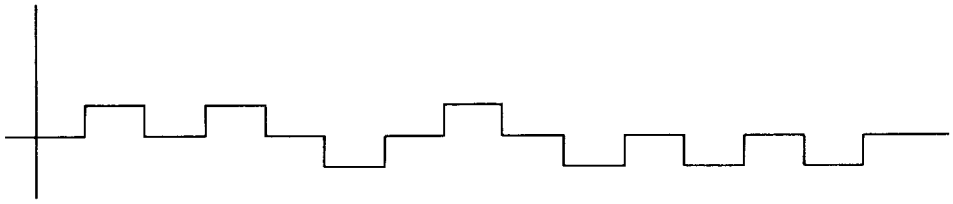
FIGS. 24 and 25 are certain waveforms associated with the modified basic system of FIG. 23.
Figure 25:
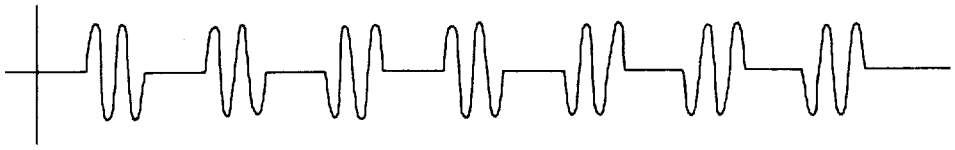

FIG. 24 shows a portion of the pseudorandom sequence which commands the polarity of the corresponding transmitter bursts (waveform) shown in FIG. 25. In order to accumulate the energy from the corresponding polarity-switched tag signals, a re-inversion is accomplished by the pseudo-random decoding circuit 132 which results in a train of pulses all with the same polarity as the input to the demodulator 100. However interferences have the property that they do not change polarity in synchronism with the transmitter hence when they are also processed through the decoding circuit 132 their polarity becomes pseudo randomized and the energy from pulse to pulse is not accumulated in demodulator 100. These waveform polarity inversions are removed in pseudo-random coding circuit 132 for the tag signals but not for interference, hence only the interferences is randomized to a noise-like background. The pseudo-random sequence generation (in FIG. 26) consists of an 8 bit shift register ($Q_0$ to $Q_7$) available in a 16 pin dip package and three modulo—2 adders ($A_1$ to $A_3$) available in a 14 pin dip package.

Figure 27:
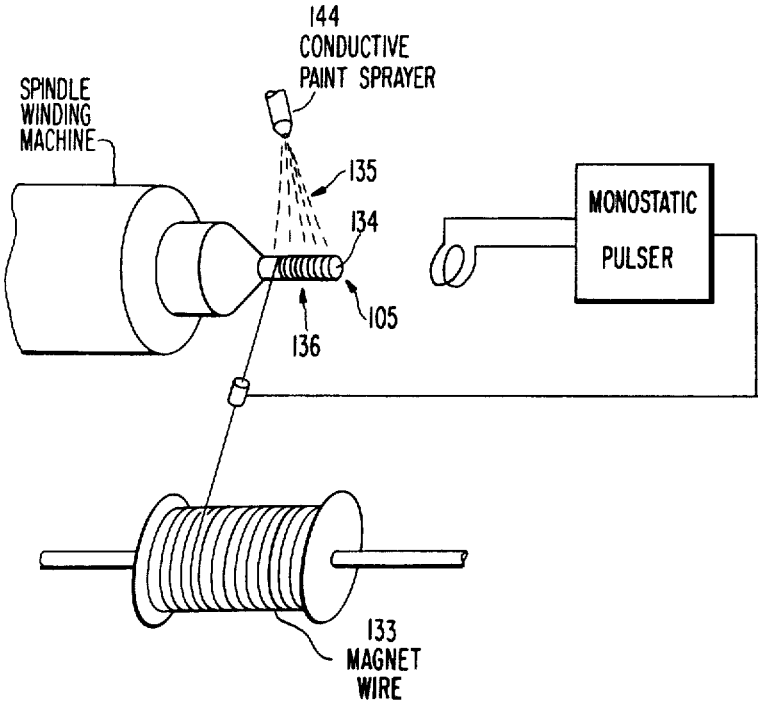
FIG. 27 is an elevational front view of a tag winding machine of this invention with automatic resonant frequency trim and dielectric enhancement sprayer.

In FIG. 27 transponder (tag) 105 is readily implemented by simply winding fine magnet wire 133 on a ferrite rod 134 as a core. (Magnetic wire 133 is insulated.) Winding 136 can contain single or multiple layers of wire 133. The interwinding capacity of wire 133 provides the mechanism for resonance with the inductance formed by winding 136. This self-capactive effect can be increased by spraying conductive paint 135 on winding 136 during construction. The aluminum particles of aluminum paint, for example, fill up the dead air space in winding 136 and maximize its interwinding capacitance so that a minimum of wire 133 is necessary. Alternatively, less wire 133 can be used but terminated in a capacitor to produce a lumped LC resonator. If winding 136 is made long and thin, an artificial delay line is formed on the core and tag 105 will generate predictable and precise multiple frequencies simultaneously allowing a simple method if identifying individual transponders 105. If several single frequency transponders 105 are stacked together (bundled) a unique series of spectral lines will be produced during repetitive pulsing.

The use of a ferrite core greatly increases the target cross-section and sharply reduces the number of turns of wire 133 required to produce a specific resonance.

Figure 28:
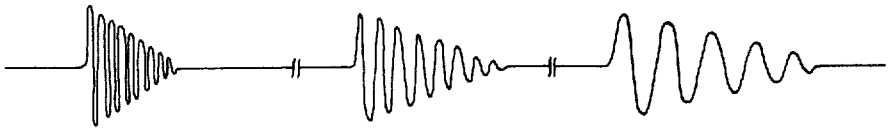
FIG. 28 is a certain waveform associated with the machine of FIG. 27.

Resonant tag 105 is continuously pulsed while being wound and the resonant frequency measured in FIG. 28 is used to sever the magnet wire when the specified value is reached.

The use of a ferrite core 134 which can be permanently magnetized has the advantage that it allows the tag to be deactivated without removal from the tagged merchandise by authorized personnel.

Figure 32:
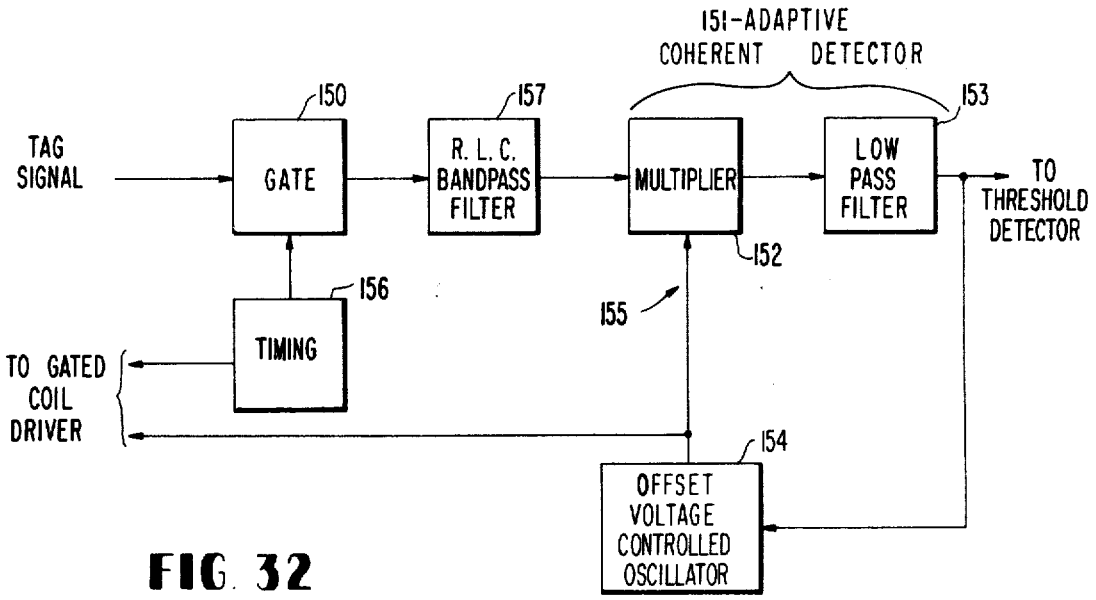
FIG. 32 is a schematic diagram of an adaptive frequency interrogator.

FIG. 32 is the block diagram of a frequency adaptive interrogator which maximizes the tag signal to noise ratio in the receiver. This implementation is motivated by the fact that mass produced tags used in various environments will have a tolerance spread in resonant frequency. Since the tag power output is maximum when the transmitter frequency is close to that of the tag there is an advantage to adapting the transmitter to each tag.

Figure 33:
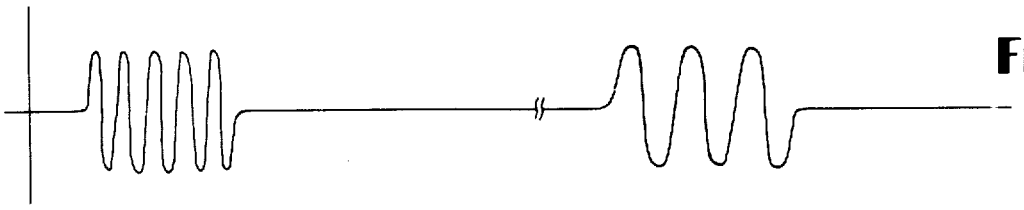
FIGS. 33 to 36 are certain waveforms associated with the system of FIG. 32.
Figure 34:
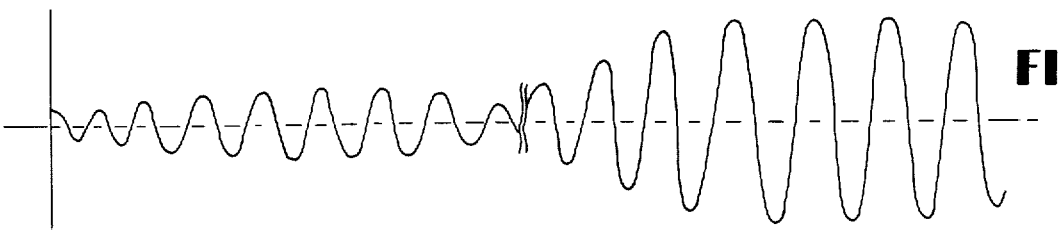
Figure 35:
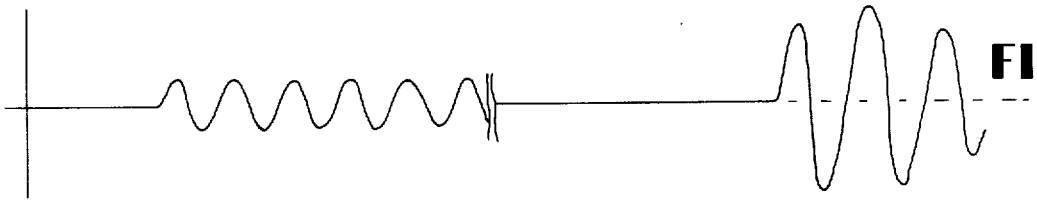
Figure 36:
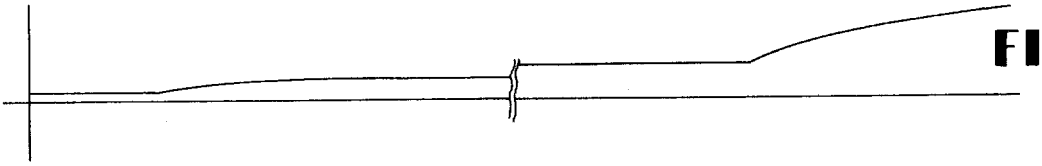

The incoming tag signal (see FIG. 34) is passed on to adaptive coherent detector 151 by way of gate 150 which is off when the transmitter (see FIG. 33) is active. The tag signal is initially multiplied 152 by a reference sinewave 155 of frequency close to that of the tag resonant frequency producing a weak dc signal out of low pass filter 153. This dc voltage is fed to voltage controlled master oscillator 154 which steers the reference sinewave and transmitter frequency closer to that of the tag increasing its power output (see FIG. 34) and hence the dc level out of low pass filter 153. The master frequency will ultimately lock onto that of the particular tag within a fraction of the residence time. Hence this interrogator forms a gated phase locked loop with the tag's resonant frequency.

In this section the power spectral density of the repetitive tag signal is determined. The effect of transmitter burst length and repetition rate on tag frequency is then determined and the desired form of the receiver will be deduced from the first two determinations. Spectral density of the tag signal The Fourier transform of a repetitive train of exponentially damped cosine waves each of which has a distinct start is:

$$F\{[e^{-at}\cos\omega_o t\,u(t)]\times\sum_{k=-\infty}^{+\infty}\delta(t-kT)]\}\doteq W(f)=$$

$$\frac{1}{T}F[e^{-at}\cos\omega_o t\,u(t)]\sum_{k=-\infty}^{+\infty}\delta(f-\frac{k}{T})$$

where

F indicates the operation of Fourier transforming $W=2\pi f$ f=frequency a=envelope time constant $$u(t)=1\ t>0$$
$$=0\ t<0$$

t=time

δ( )=unit impulse

T=pulse repetition period k=all integers, 0 to ∞

Σ=the operation of summation $$F[e^{-at}\cos\omega_o t\,u(t)]=\tfrac{1}{2}\frac{1}{a+i(\omega-\omega_o)}+\tfrac{1}{2}\frac{1}{a+i(\omega+\omega_o)}\doteq G(f)$$

THE POWER SPECTRAL DENSITY:

$$S(f)=|W(f)|^2=\frac{1}{T^2}\left|G(f)\sum_k\delta(f-\frac{k}{T})\right|^2$$

$$=\frac{1}{T^2}\left|\sum_k G(\frac{k}{T})\,\delta(f-\frac{k}{T})\right|^2=S(\frac{k}{T})$$

WHEN EVALUATED AT $f=\frac{K}{T}$, $$S(\frac{K}{T})=\frac{1}{T^2}\left|G(\frac{K}{T})\delta(0)\right|^2$$

$$=\frac{1}{T^2}\left|G(\frac{K}{T})\right|^2\delta(0)$$

Therefore the Spectral Density of the periodic tag waveform, like W(f), consists of a set of spectral lines at $f_k=k/T$; but the amplitude of each line is $$\frac{1}{T^2}\left|G\left(\frac{K}{T}\right)\right|^2 \text{ WHERE:}$$

-continued $$\left|G\left(\frac{K}{T}\right)\right|^2 \approx \frac{4\pi^2 \frac{K^2}{T^2}}{\left\{a^2 - 8\pi^2 \frac{K}{T} \Delta f\right\}^2 + 16\pi^2 a^2 \frac{K^2}{T^2}}, \frac{K}{T} \approx f_o$$

Figure 29:
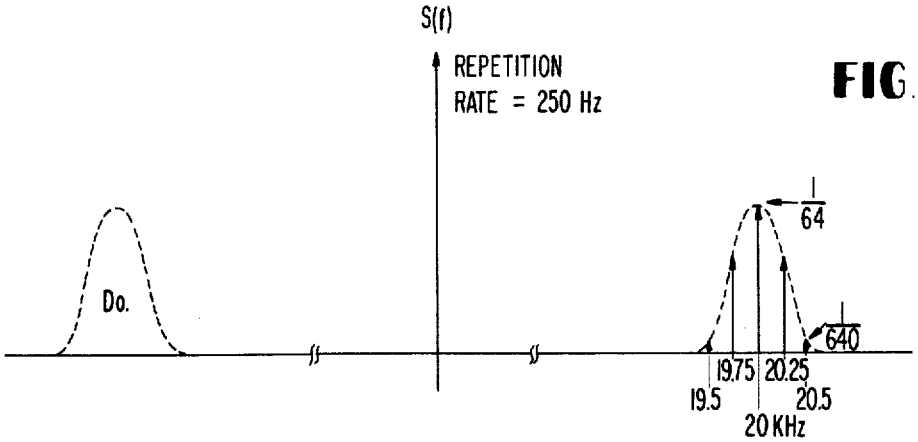
FIGS. 29 to 31 are waveforms involving certain transmitter repitition rates in the system of this invention.
Figure 30:
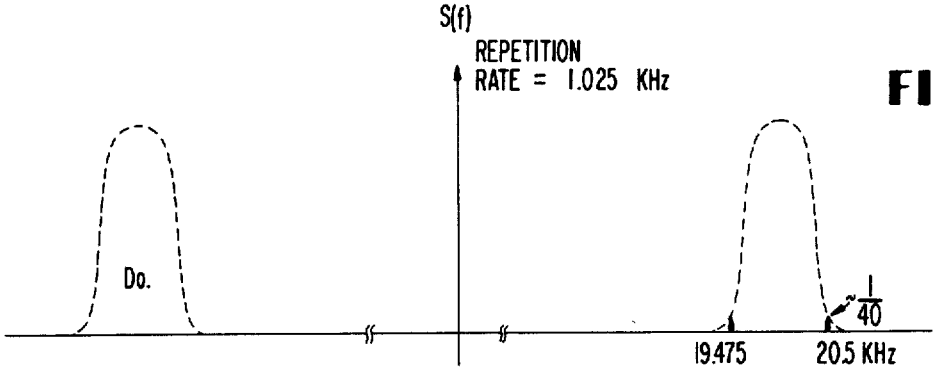
Figure 31:
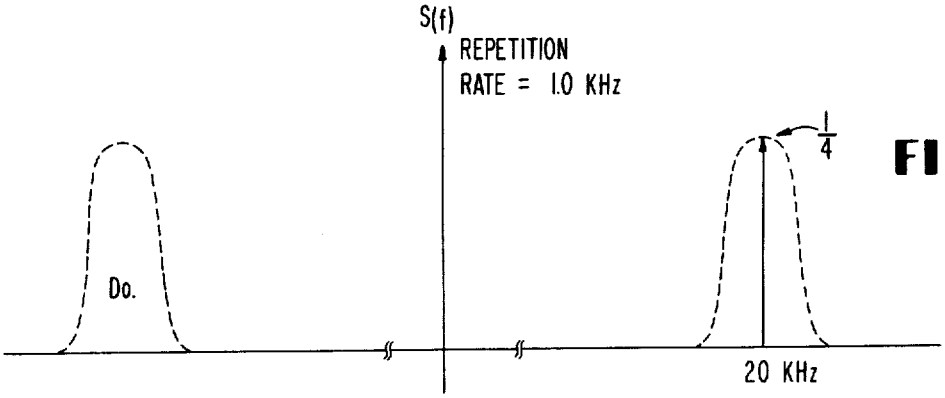

A nominal tag wound to resonate at 20 KHz on a piece of ferrite ¼ inch in diameter and 1 inch long has an envelope time constant of 1 millisecond, hence $a=10^3$, $W_0=2\pi\times 20\times 10^3$. The corresponding Power Spectral Density for three values of transmitter repetition rate are shown in FIGS. 29, 30 and 31. The Spectral Density for three values of transmitter repetition rate are shown in FIGS. 29, 30 and 31. The Spectral lines are drawn to 10 percent of the (envelope) maximum $1/4a^2T^2$ in a bandwidth of $3a/\pi=954$ Hz. At low repetition rates the number of spectral lines within the 10 percent points is approximately $3aT/\pi$ and the approximate power they contain is proportional to $$\frac{3aT}{\pi} \cdot \frac{1}{4a^2T^2} = \frac{3}{4\pi aT}.$$

This means that the highest repetition rate which still insures several lines within the envelope yields the best signal strength from the tag and provides dependable assurance that the energy will transfer to the tag.

FIG. 30 is a counter example where a particular selected repetition rate leads to very little signal energy from tag 105. This corresponds to the case of the remnant tag energy which still exists at the following transmitter burst onset substracting from the energy buildup during that transmitter burst.

FIG. 31 is an example of a high repetition rate which has fortuitous timing relative to the tag resonant frequency (it is an exact submultiple). Here the remnant energy in the tag exactly adds to the energy injected into the tag by the following transmitter burst. The net power radiated by the tag here is markedly higher than the example of FIG. 29—actually about 9.3 db. This means a frequency-adaptive interrogator can be used to peak-up the excitation. However, to properly compare these two situations the transmitter power must be normalized to the same value. The improvement factor then is 3 db. which does not make a frequency-adaptive interrogator always preferable considering the added complexity. Situations may occur where the adaptive feature itself may be necessary. A block diagram of an adaptive interrogator is shown in FIG. 32.

The transmitter burst length must be greater than approximately $\pi/3a=1.04$ millisecond to achieve the maximum energy transfer to the tag.

The optimum receiver is the matched filter to the tag waveform followed by accumulation of the values obtained over the observation interval. Note that since the observation interval is about 0.5 second, the spectral lines of the matched filter transfer function are actually narrow windows each approximately 4 hz wide. This is achieved in the implementations of FIG. 14, 19 and 32 by the use of Rc feedback in summing amplifiers 125, 133 and 153.

The core is preferably ferrite but can be constructed of any other suitable material in which flux lines are concentrated in order to enhance the effectiveness of the tag. Examples are laminated iron, high permeable iron, high permeable alloys of iron (used at high frequencies), sintered iron particles, and the like. The core can be constructed of any material which works at the appropriate frequency. The tag can be a winding with an air core.

An alternative to the sinusoidal burst transmitter signal is a dc pulse type transmitter magnetic field. Here the coil drive applies dc voltage across the transmitter coil for predetermined time resulting in current build up. Excitation is rapidly removed and rapid coil current decay ensues. The tag has absorbed some magnetic field which now decays as a high Q oscillation. These oscillations are picked up by receiver coil, amplified and applied to an N-pole processor.

An alternative or addition to the receiver low pass filter, threshold detector and alarm circuits shown, is a frequency down-converter and loudspeaker which provides an audible tone for identification of tag presence near the interrogator.

What is claimed is:

1. A system for indicating the presence of a passive electronic tag transponder, which is a self-resonant structure with non critical sharpness-of-resonance and center frequency values that produces magnetic oscillations when excited of sufficiently low frequency to penetrate metal, which comprises:

(a) transmitting means which by a pulsed magnetic field of fixed repetition rate excites the passive electronic tag transponder, whereby magnetic oscillations are produced which form lightly damped sinusoidal magnetic field bursts in repetitive coordination with the transmitting means excitations; and (b) receiver module means which detects the magnetic oscillations produced by the excited passive electronic tag transponder during the residence time of the transponder in the portion of said field which is received by said receiver means, said receiver means coherently accumulating the received spectral energy of each tag burst of any received signal amplitude during the residence time of the transponder within the portion of said field which is received by said receiver means.

2. System as claimed in claim 1 wherein said transmitting means produces alternate polarity dc magnetic field pulses and wherein said receiver means (a) includes a detector for yes/no decision on the presence of said tag and (b) demodulates said spectral energy of said tag bursts during the residence time of said tag within the portion of said field which is received by said receiver means in a series of N narrow band spectral windows which occur at harmonic frequencies of the repetition rate of said transmitting means and delivers the set of said demodulated spectral components to said detector.

* * * * *